United States Patent [19]

Rowley et al.

[11] 4,010,990

[45] Mar. 8, 1977

[54] GOODS CONTAINER FOR TRANSPORT PURPOSES

[75] Inventors: Robert John Rowley, Peterborough; David Allen, Kettering, both of England

[73] Assignee: Modular Distribution Systems Limited, Kettering, England

[22] Filed: Oct. 20, 1975

[21] Appl. No.: 624,244

[30] Foreign Application Priority Data

Oct. 21, 1974 United Kingdom ..... 45387/74

[52] U.S. Cl. ..... 312/255; 248/188

[51] Int. Cl.[2] ..... A47B 91/00; A47B 95/00; F16M 11/16

[58] Field of Search ..... 312/253, 255; 248/188, 248/188.2, 188.5, 188.6, 151

[56] References Cited

UNITED STATES PATENTS

| | | | |
|---|---|---|---|
| 733,984 | 7/1903 | Lucas | 248/188.5 |
| 2,190,498 | 2/1940 | Williams | 312/255 |
| 2,340,540 | 2/1944 | Lange | 312/253 |
| 2,569,117 | 9/1951 | Schade | 312/255 |
| 2,615,593 | 10/1952 | Wolforth | 248/151 |
| 2,665,938 | 1/1954 | McCrossen | 248/188.5 |
| 2,776,180 | 1/1957 | Knuepfer | 312/255 |
| 2,913,207 | 11/1959 | Eash | 248/188.2 |
| 3,879,796 | 4/1975 | Whyte | 248/188.5 |
| 3,915,102 | 10/1975 | Barron | 248/188.5 |

FOREIGN PATENTS OR APPLICATIONS

| | | | |
|---|---|---|---|
| 337,445 | 5/1959 | France | 312/255 |
| 841,095 | 7/1960 | United Kingdom | 312/255 |
| 820,391 | 9/1959 | United Kingdom | 312/255 |

*Primary Examiner*—Paul R. Gilliam
*Assistant Examiner*—V. Sakran
*Attorney, Agent, or Firm*—Larson, Taylor and Hinds

[57] ABSTRACT

For facilitating the picking up and setting down of a container in a containerised goods transport system, there is provided at each corner of the container a lifting arrangement comprising a retractable leg housed with an operating ram in a post which is mounted by hinges on a corner frame member to swing about a vertical axis between a position laterally outboard of the container to allow the leg to be extended, and a stowed position in which the post with leg retracted is housed in a recess in a corner frame member so occupying otherwise non-used space.

8 Claims, 20 Drawing Figures

GOODS CONTAINER FOR TRANSPORT PURPOSES

This invention relates to goods containers for transport purposes and is particularly concerned with the type of goods container which is intended to be readily demountable from a rail or road transport vehicle when the container is to be loaded or emptied.

Many of such containers as used at present must be placed in position on and removed from the vehicle by means of a container crane. As a result, unless a user handles such a large number of such containers as to warrant provision of a crane, the container cannot be removed from the vehicle so that the vehicle is idle during loading or unloading of the goods from the container.

This invention provides a support apparatus for a container having built-in, telescopic posts which can be swung from a stowed position within the general geometry of the container to a laterally-outboard position in which the posts can be extended to lift and support the container clear of the vehicle chassis.

Conveniently, the corner frame members of the container have recesses in them to house the stowed posts and the posts are hinged to the frame members to swing outwardly laterally clear of the container. Locking devices will be provided to locate the posts in the stowed and operative positions.

One arrangement of this invention is illustrated in the accompanying drawings in which.

Figure 3:
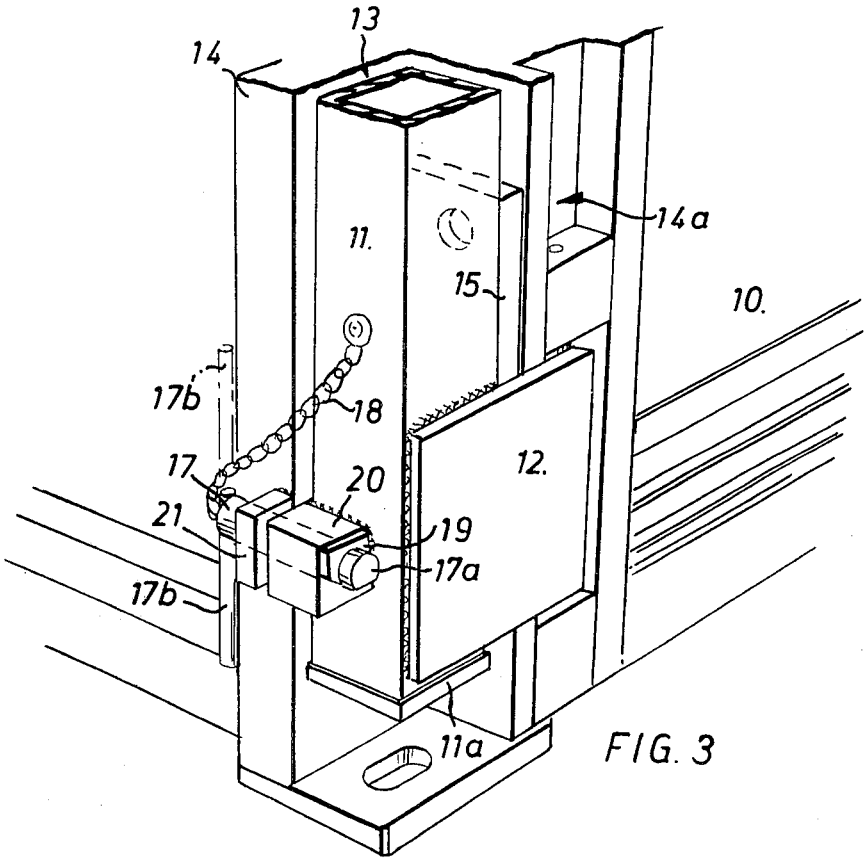
Figure 5:
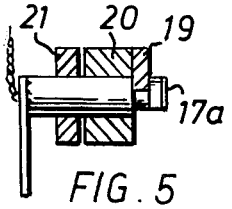
Figure 6:
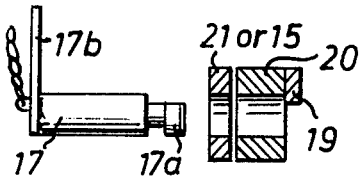
Figure 7:
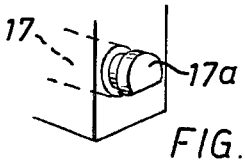
Figure 4:
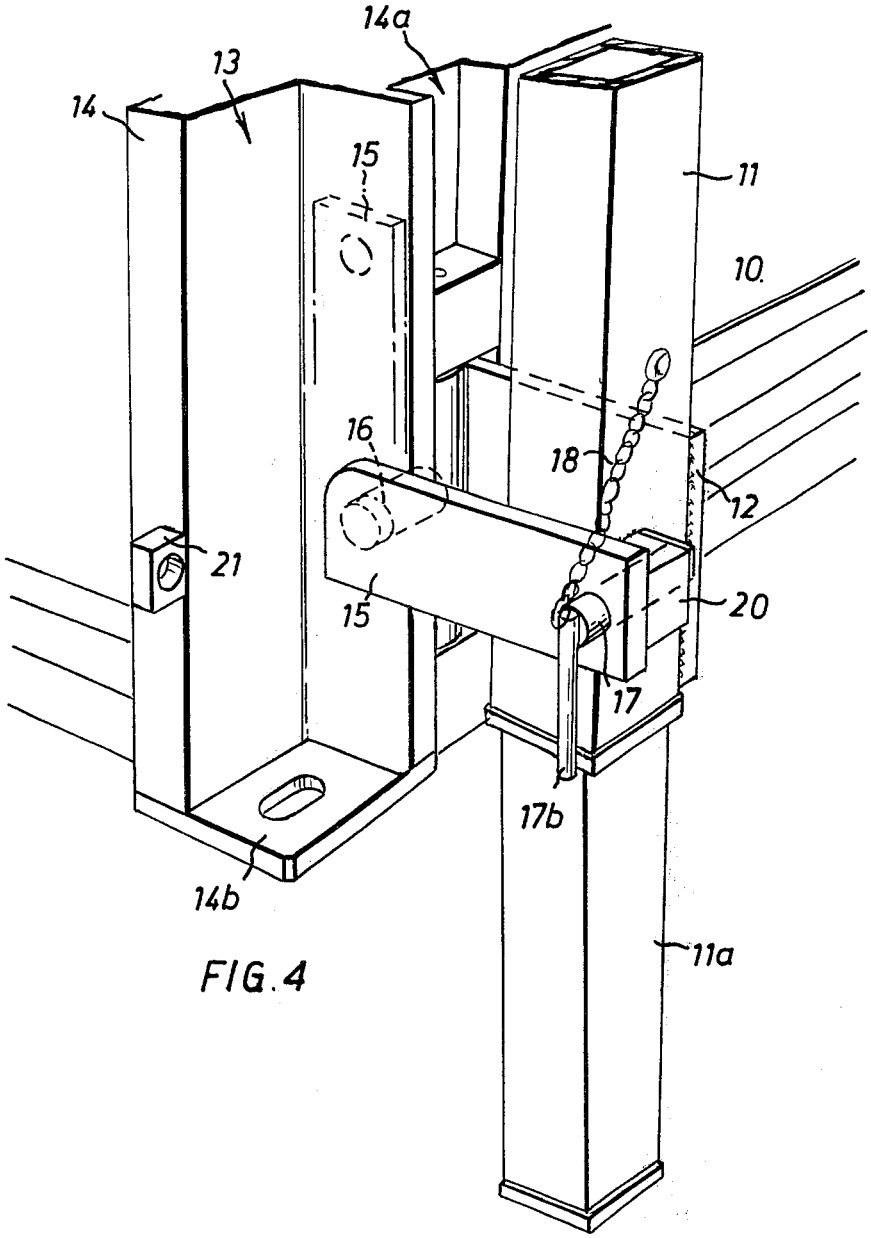
Figure 8A:
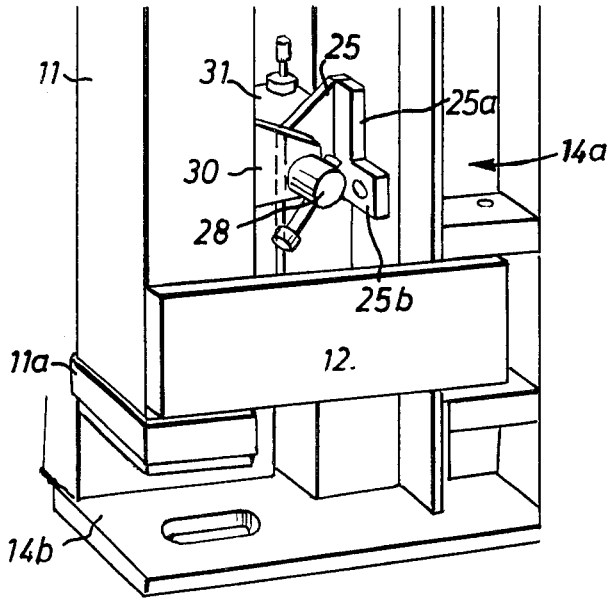
Figure 8B:
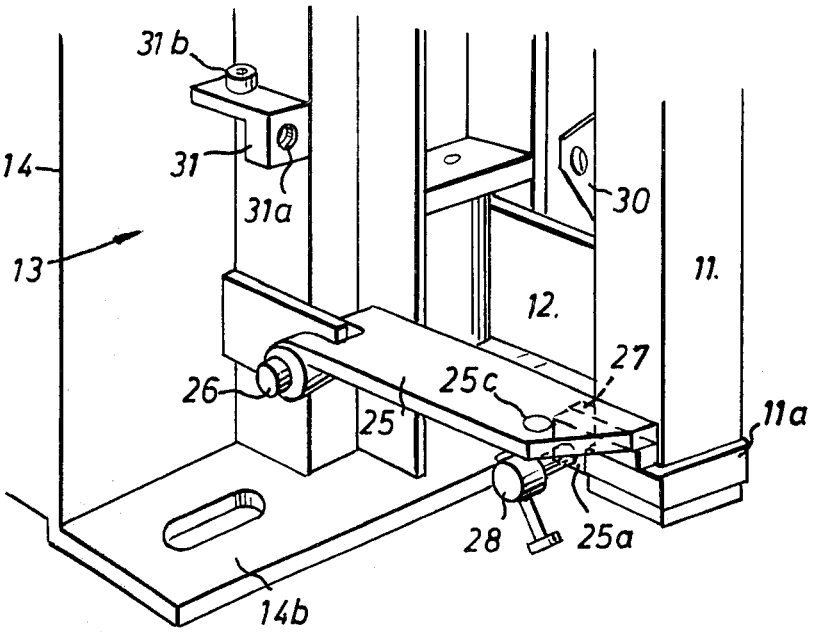
Figure 8C:
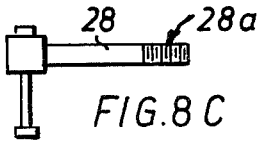
Figure 9A:
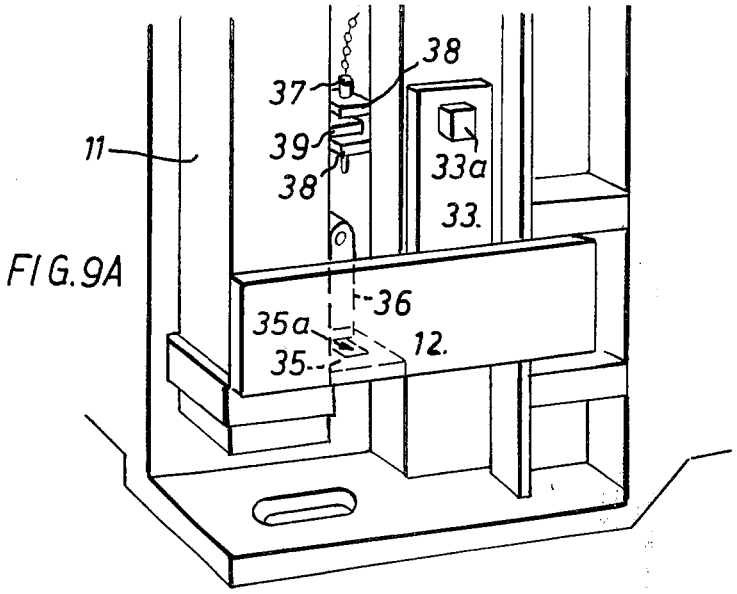
Figure 9B:
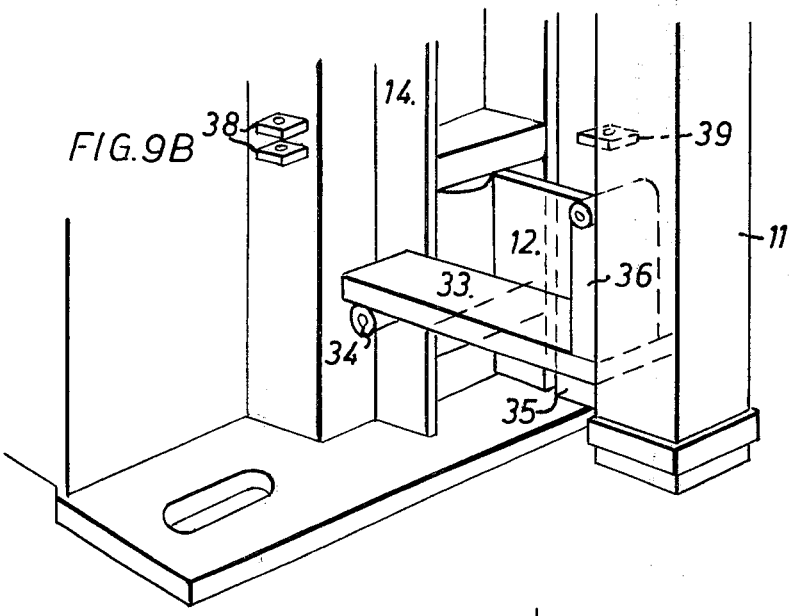
Figure 9C:
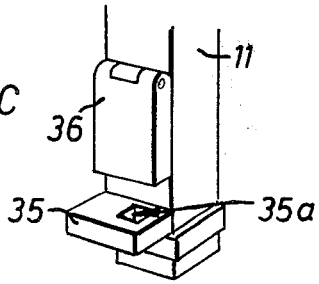
Figure 10A:
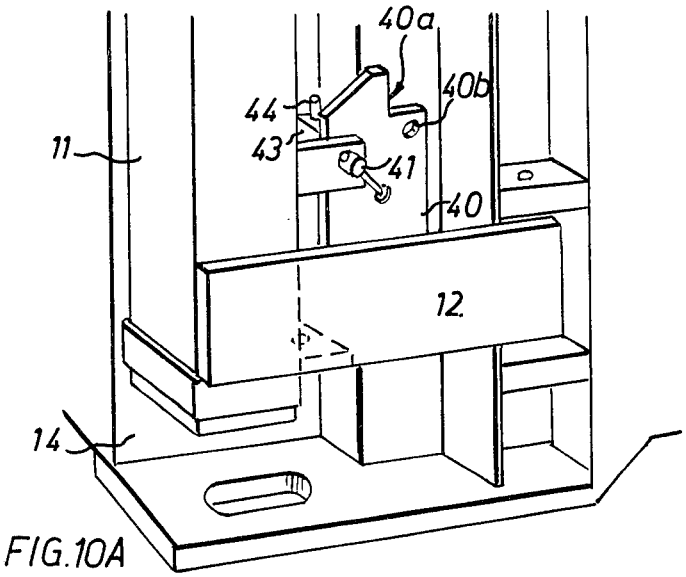
Figure 10B:
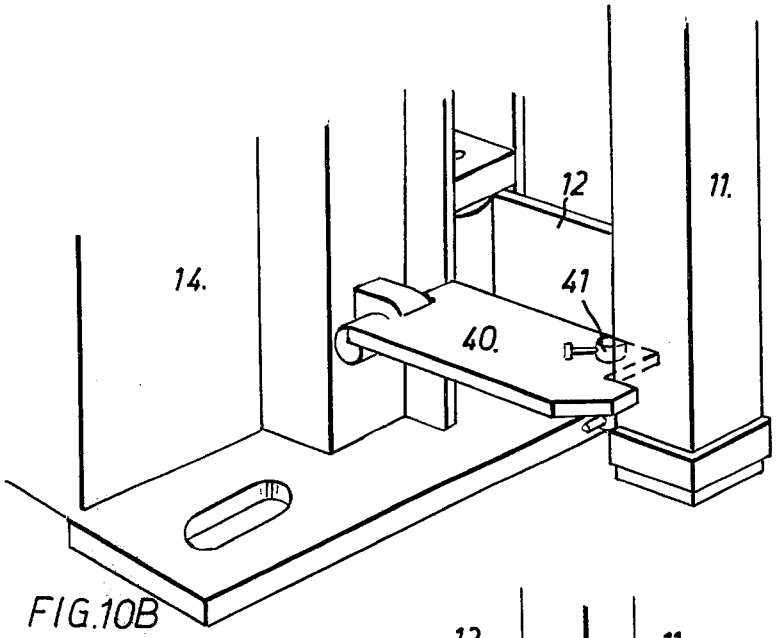
Figure 10C:
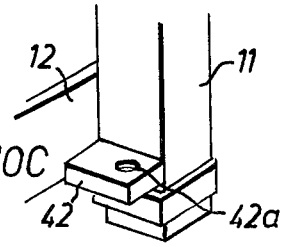
Figure 11A:
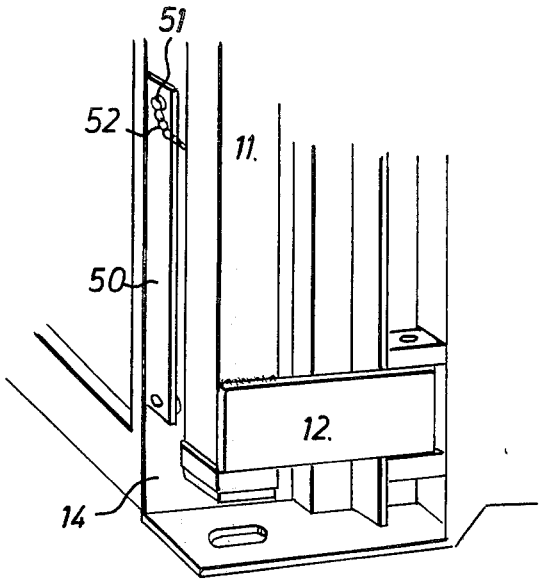
Figure 11B:
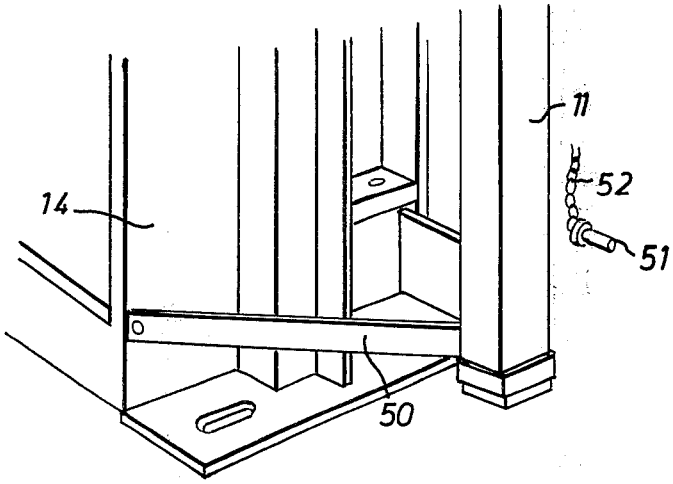
Figure 12A:
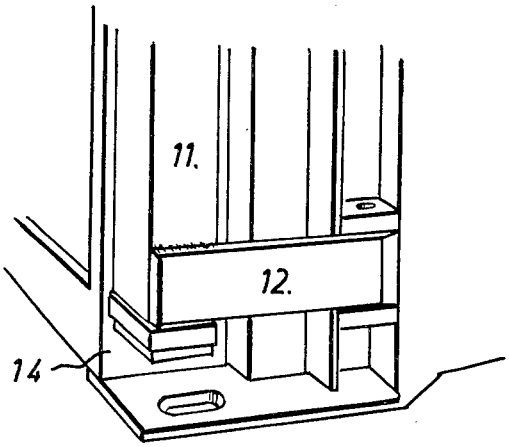
Figure 12B:
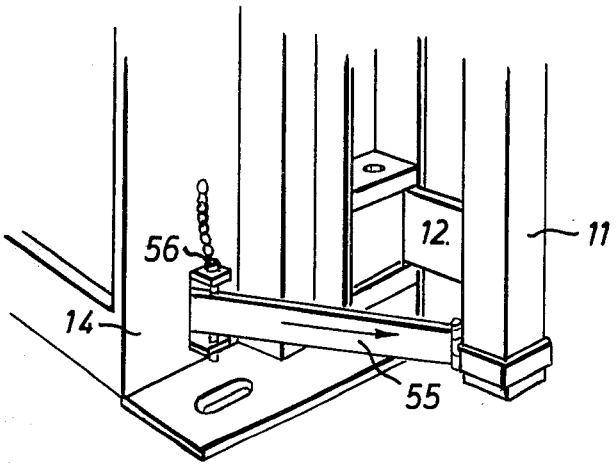

FIGS. 3 and 4 are views of a post in the stowed and operative positions respectively, FIGS. 5, 6 and 7 show details of the construction of FIGS. 3 and 4, FIGS. 8A, 8B and 8C illustrate one form of locking device for holding a housing with its leg retracted in the stowed position and for holding the housing in the outboard position, FIGS. 9A, 9B and 9C illustrate a second form of locking device, FIGS. 10A, 10B and 10C illustrate a third form of locking device, FIGS. 11A and 11B illustrate a fourth form of locking device, and FIGS. 12A and 12B illustrate a fifth form of locking device.

Figure 1:
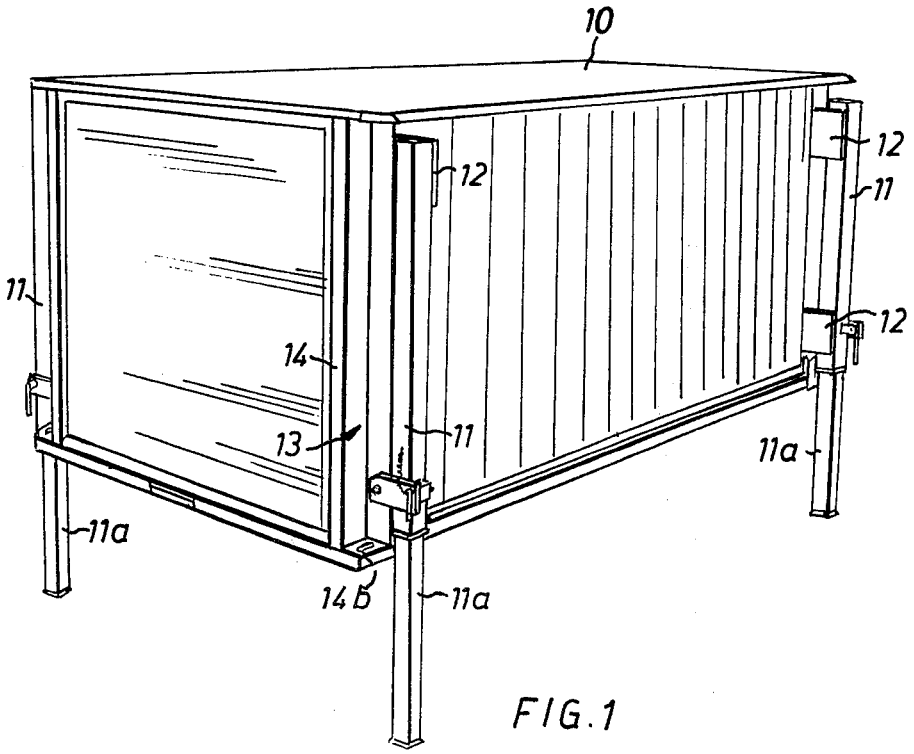
FIG. 1 shows a container supported by telescopic corner posts.
Figure 2:
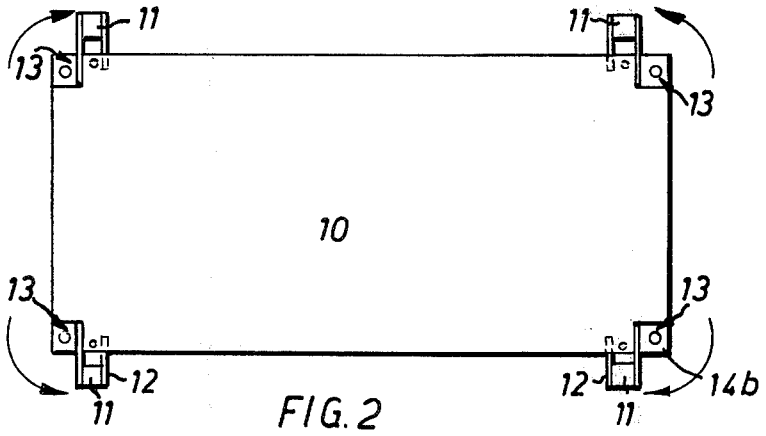
FIG. 2 is a diagrammatic plan of FIG. 1.

The container 10 (FIGS. 1 and 2) has a telescopic post 11 at each vertical corner so as to be self-supporting. The posts 11 when collapsed can be swung on hinges 12 from the laterally-outboard position shown into rebated recesses 13 in pillars consisting of appropriately profiled corner frame members 14 of the container 10. The recesses 13 are laterally open and extend vertically between ISO castings (a standard designation of the corner fitment of standard containers to be engaged by the well known standard twist lock devices provided on vehicles and handling equipment) or the like fitments **14*b*** provided for facilitating handling of the container for example by a crane or other conventional lifting gear.

Each post 11 in the illustrated construction is a rectangular-sectioned housing secured to the hinge plates of top and bottom hinges 12 and slidingly accommodating a rectangular leg **11*a*** (shown retracted in FIG. 3).

The hinge pins are accommodated in a channel **14*a* in the profiled frame member 14. The post 11 also accommodates a ram for operating the leg 11*a*, the ram being connected by trunnion pins to the leg 11*a* and to the post 11.**

The rams are conveniently hydraulic rams and in a preferred arrangement separate valve-controlled hydraulic power packs are provided for the front pair and the rear pair of telescopic posts respectively, there being a separate valve for each post to ensure that each leg **11*a*** takes an equal share of the load when lifting the container.

The power source may be a heavy duty battery, the battery of the transport vehicle or a mains supply at the loading and unloading point.

To lock the post 11 in the outboard position (FIGS. 1, 2 and 4), there is provided a locking device in the form of a heavy-gauge plate 15 which is pivoted at 16 to the frame member 14 within the recess 13, which plate can be swung downwardly to extend in front of the post 11 to act to prevent the post swinging towards the recess 13. The plate 15 can also be locked by a locking pin 17 to the post 11. When not required, the plate 15 is swung into a vertical position (FIG. 3) and is retained in this position by the lower hinge plate 12 when the post is swung to the stowed position.

The pin 17 is attached to the post 11 by a chain 18 and is also used to lock the post in the stowed position. The pin has a half-round head **17*a* beyond a peripheral groove so that the pin can only pass a stop 19 on an eye block 20 when the pin handle 17*b* extends vertically upwards. The frame member 14 has a pierced lug 21 for passage of the pin 17** when the post is to be locked in the stowed position.

Instead of the frame member 14 being provided (as shown) with an ISO twistlock plate **14*b***, Freightliner lift pockets may be provided.

Referring now to FIGS. 8A to 8C, the form of locking device comprises a strut-forming plate 25 pivoted at 26 to swing about a horizontal axis from a stowed position (FIG. 8A) to a locking position (FIG. 8B) in which a hole **25*b* in a lug 25*a*, which is welded to the underside of the plate, is aligned with a threaded hole in a lug 27 secured to the lower end of the post 11. The plate is locked to the post by a threaded retainer 28 which passes through the hole in lug 25*a* into engagement with the threaded hole in lug 27.**

In the stowed position, the retainer 28 extends through a hole in a further lug 30 on the post 11 and a hole **25*c* in the plate 25 into a threaded hole 31*a* in a block 31 welded to the frame member 14. Unscrewing of the threaded pin 28 is prevented by a locating pin passing through a boss 31*b* on the block into a hole 28*a* (FIG. 8C) in the retainer 28.**

The form of locking device illustrated in FIGS. 9A to 9C comprises a strut-forming plate 33 pivoted at 34 on the frame member 14 to swing downwardly from a stowed position (FIG. 9A) to a locking position in which the plate 33 rests on lug 35 at the lower end of the post 11 and is held against the lug 35 by a pivoted flap 36 on the post 11. A boss **33*a* on the underside of the plate 33 enters a hole 35*a* in the lug 35 to ensure correct location of the post 11. In the stowed position of the plate 33 and post 11 (FIG. 9B), the plate 33 is prevented from dropping down by the lower hinge plate 12 and the post 11 is prevented from swinging outwards by a pin 37 passing through aligned holes in fixed lugs 38 between which enters a lug 39 on the post 11.**

In FIGS. 10A to 10C, the locking device comprises a horizontally-pivoted, strut-forming plate 40 which has a notch 40*a* in its end to position the post 11 correctly in the outboard setting and the plate is locked to the post 11 by a threaded retainer 41 which extends through a hole 40*b* in the plate into threaded engagement with a hole 42*a* in a lug 42 on the post. In the stowed position, the lower hinge plate 12 prevents downward pivoting of the plate 40 and the retainer 41 passes through a hole in the plate 40 into engagement with a threaded hole in a block 43 welded to the frame member 14. A pin 44 extends through holes in the block 43 and in the retainer 41 to prevent inadvertent detachment of the retainer 41 and to provide rapid visual indication that the stowed parts are properly locked.

FIGS. 11A and 11B show a locking device comprising a strut-forming bar 50 pivoted on the frame member 14 to swing downwards from the stowed position, in which a retainer 51 on a short chain 52 is used to hold the strut and post in position, and a locking position (FIG. 11B) in which the retainer 51 attaches the free end of the strut 50 to the post 11.

In FIGS. 12A and 12B, a strut-forming bar 55 is hinged to the lower end of the post 11 and, as the post is swung between its stowed and laterally-outboard positions, slides through a slot in the frame member 14. A retainer 56 is used to lock the strut 55 to the frame member 14 in each of the end positions.

With constructions according to the invention, the container may be loaded on to and unloaded from a vehicle without the use of a container crane, and after off-loading can be lowered to a desired level, and further, since the posts are laterally outboard of the container, the container may be loaded and unloaded from either a road or rail vehicle at any suitable site.

When stowed the posts are accommodated neatly within the general geometry of the container and so the container does not occupy any more space than a conventional container. Further, being in recesses between ISO or the like handling fitments, the posts do not occupy space which would be otherwise usefully used.

Operation is also simple and does not require great physical effort.

As alternatives to the hydraulic power arrangement above described, each leg may have a separate hydraulic pump whereof the output is controlled by a lever-actuated valve, or there may be a pump having a split delivery, one for each of the legs at one end of the container, each delivery including control valve.

We claim:

1. A goods container for use in containerised goods transport systems, comprising a container body which is provided at each vertical corner with a retractable leg structure, said structure comprising a fixed pillar having a vertically-extending recess which is open laterally of the container, a tubular post hinged to said pillar to swing about a vertical axis between a stowed position within the recess and an operative position extending laterally outboard of the container, a hollow ground-engaging leg slidably engaged in the tubular post to move vertically, each of said post and leg being of corresponding rectangular cross-sections, a ram accommodated within and connected between the post and the leg to effect sliding of the leg, and locking means for retaining the post in its stowed and operative positions, the locking means including a part which is mounted on the pillar to move into and out from the recess and which engages the post in its operative position to prevent the post moving to its stowed position and which is retained in the recess by the post when the latter is stowed.

2. A goods container as claimed in claim 1 wherein said part includes a plate which swings downwardly about a horizontal axis from a position within the recess to a position in which it is operative to prevent swinging of the post from the laterally-outboard position.

3. A goods container according to claim 2, wherein the locking devices include retainers for securing the post and plate together in the laterally-outboard position and for securing the post to the pillar structure in the stowed position.

4. A goods container according to claim 2, wherein the plate, when swung down, lies in the path of the post to prevent it from swinging from the laterally-outboard position.

5. A goods container according to claim 2, wherein the plate, when swung down, acts as a strut holding the post in the laterally-outboard position.

6. A goods container according to claim 1, wherein the post has hinge plates connecting it to the pillar structure and a hinge plate is arranged to hold the retractable part within the recess.

7. A goods container according to claim 1, wherein the locking devices comprise a strut-forming bar pivoted to the pillar structure, and a retainer by which a free end of the bar is secured to the post in its laterally outboard position.

8. A goods container according to claim 1, wherein the locking devices include a bar hinged by one end to the post and slidable in the pillar structure as the post is swung between its stowed and laterally-outboard positions, and a retainer to secure the bar to the pillar structure in each of said positions.

* * * * *